US005494714A

United States Patent [19]

Huang

[11] Patent Number: 5,494,714

[45] Date of Patent: Feb. 27, 1996

[54] BELL

[76] Inventor: Chung-Shyan Huang, No. 1-1, Chang Mar Street, Hsiu Shui Hsiang, Chang Hua Hsien, Taiwan

[21] Appl. No.: 345,871

[22] Filed: Nov. 28, 1994

[51] Int. Cl.[6] ..... G10K 1/00

[52] U.S. Cl. ..... 428/11; 116/148

[58] Field of Search ..... 428/11; 84/406; 116/148

[56] References Cited

U.S. PATENT DOCUMENTS 4,113,020 9/1978 Panetta ..... 428/11 X
4,349,065 9/1982 Schall ..... 164/368
4,425,602 1/1984 Lansing ..... 428/11 X
4,592,936 6/1986 Ferguson ..... 428/11

*Primary Examiner*—Henry F. Epstein
*Attorney, Agent, or Firm*—Charles E. Baxley

[57] ABSTRACT

A bell includes two shells coupled together by a common foldable coupling element and foldable relative to each other for engaging with each other when folded at the coupling element. One of the shells includes a number of depressions, and the other shell includes a number of ears for engaging with the depressions so as to secure the shells together and so as to form the bell. The bell includes a configuration that is excellent for manufacturing purposes. A gap will be formed between the shells for facilitating sound transmitting effect.

1 Claim, 2 Drawing Sheets

BELL

BACKGROUND OF THE INVENTION

1. Field of the Invention

The present invention relates to a bell, and more particularly to a bell having a novel configuration.

2. Description of the Prior Art

A typical bell is disclosed in U.S. Pat. No. 4,349,065 to Schall, issued on Sep. 14, 1982. A typical bell comprises a globe shape with single-piece shell. In order to manufacture such bells, a number of upper and lower mold pieces and a number of processes are required to treat a single piece so as to form the globe shaped bells. In addition, the sounder cannot easily be engaged within the bell.

The present invention has arisen to mitigate and/or obviate the afore-described disadvantages of conventional bells.

SUMMARY OF THE INVENTION

The primary objective of the present invention is to provide a bell including a configuration that can be easily manufactured.

In accordance with one aspect of the invention, there is provided a bell comprising a first shell and a second shell coupled together at at least one coupling element and foldable relative to each other for engaging with each other when folded at the coupling element, the first shell including a first engaging means, and the second shell including a second engaging means for engaging with the first engaging means so as to secure the first shell and the second shell together and so as to form the bell.

The first engaging means includes at least one depression, the second engaging means includes at least one ear for engaging with the depression so as to secure the shells together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
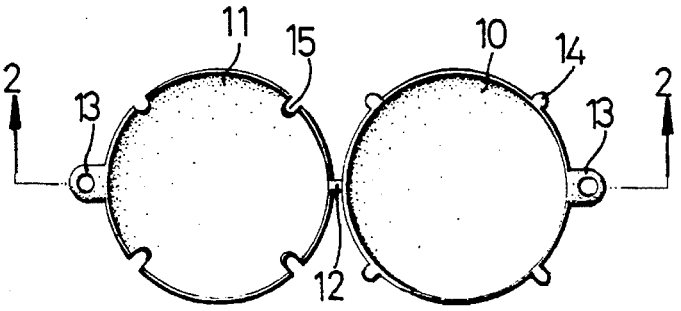
FIG. 1 is a top plane view of a prototype of an open bell in accordance with the present invention.
Figure 4:
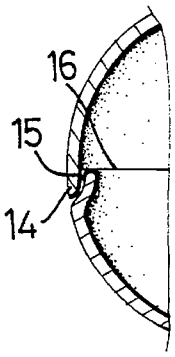
FIG. 4 is a cross sectional view taken along lines 4—4 of FIG. 3.

Referring to the drawings, and initially to FIGS. 1 to 4, a bell in accordance with the present invention comprises two shells 10, 11 each including a semi-spherical configuration. The two shells 10, 11 are coupled together at a coupling element 12 and are foldable relative to each other about the coupling element 12 so as to form a bell of globe shaped configuration, best shown in FIG. 3. The shells 10, 11 each includes an eye 13 distal to the coupling element 12. The eyes 13 are engaged with each other when the shells 10, 11 are folded to form the globe shape. One of the shells 10 includes four ears 14 extended radially outward therefrom for engaging with four depressions 15 of the other shell 11 so as to secure the shells 10, 11 together.

Figure 2:
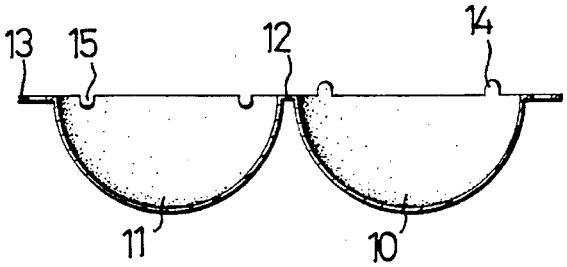
FIG. 2 is a cross sectional view taken along lines 2—2 of FIG. 1.
Figure 3:
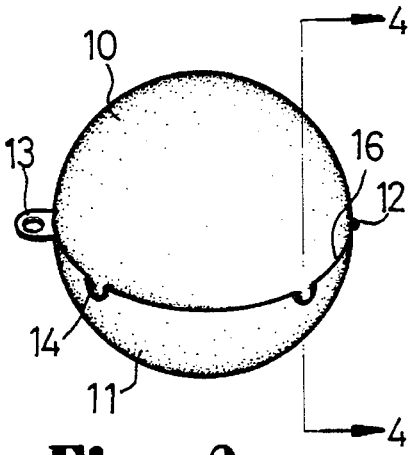
FIG. 3 is a isometric view of the bell closed.

It is to be noted that the shells 10, 11, the eyes 13, the coupling element 12, the ears 14 and the depressions 15, as shown in FIGS. 1 and 2, may be formed with a single pair of upper and lower molds, and may be formed with only one molding process. Another process is required to fold the ears 14 to engage with the depressions 15, such that the configuration of the bell is excellent for manufacturing purposes. The shells 10, 11 are not required to be aligned with each other during assembling processes due to the coupling element 12; i.e., the shells 10, 11 can be easily aligned with and engaged with each other when folded at the coupling element 12. In addition, a sounder can be easily disposed within the bell before the shells 10, 11 are coupled together. A gap 16 will be formed between the shells 10, 11 such that the sounds generated by the striking engagement between the shells and the sounder can be easily transmitted outward of the bell.

Figure 5:
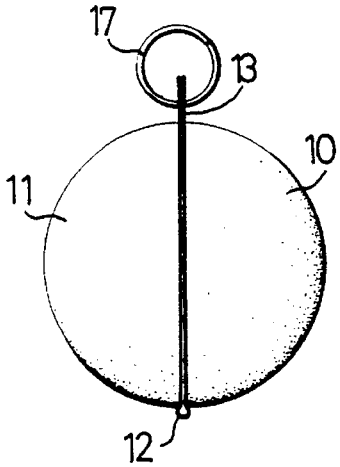
FIGS. 5, 6, 7, 8 are side views illustrating several applications of the bell.

Referring next to FIG. 5, a ring, such as a key ring 17 may be engaged with the eyes 13 for coupling the bell to other objects.

Figure 6:
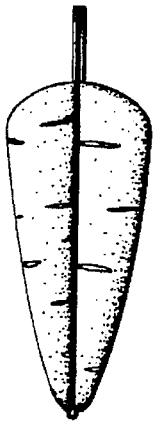
Figure 7:
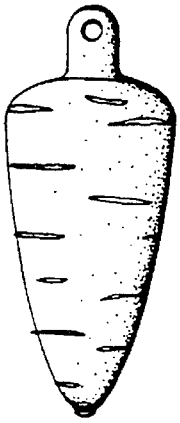
Figure 8:
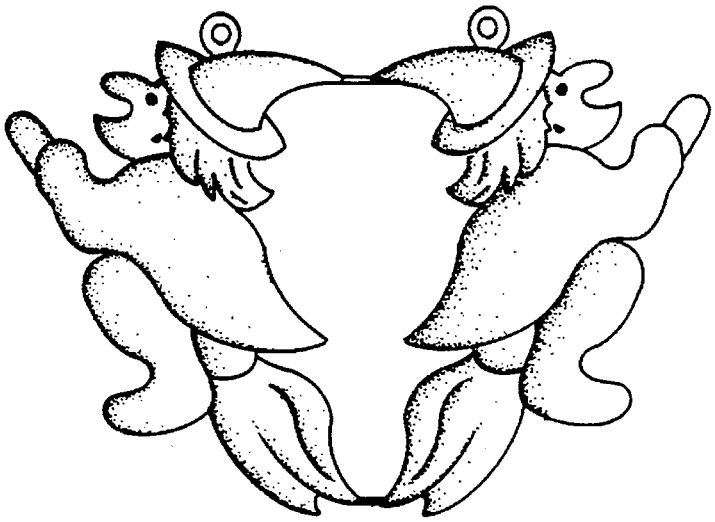

Referring next to FIGS. 6 to 8, the shells can be formed with different shapes, such as carrot shape, witch shape and other shapes. The bells may also include two shells folded at a coupling element and coupled together so as to form various other shapes. The two shells may be coupled together at two coupling elements as shown in FIG. 8.

Accordingly, the bell in accordance with the present invention includes a configuration that can be easily manufactured.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bell comprising in combination:

a first shell and a second shell coupled together by a common foldable coupling member with the shells foldable thereabout for engagement with each other and for receiving a sounder therein, said first shell including at least one depression formed therein, said second shell including at least one ear formed thereon for engaging with said depression so as to secure said shells together, and said first shell and said second shell each including an eye tab formed thereon distal from said coupling member, said eye tabs being engaged with each other when said first shell and said second shell are folded relative to each other about said coupling member.

* * * * *